US009084060B2

(12) United States Patent
Liu et al.

(10) Patent No.: US 9,084,060 B2
(45) Date of Patent: Jul. 14, 2015

(54) TEST DEVICE AND TEST METHOD FOR ACTIVE NOISE REDUCTION HEADPHONE

(71) Applicant: Goertek Inc., Weifang, ShanDong Province (CN)

(72) Inventors: Song Liu, Weifang (CN); Jian Zhao, Weifang (CN); Yang Hua, Weifang (CN)

(73) Assignee: Goertek, Inc., Weifang, Shandong Province (CN)

( * ) Notice: Subject to any disclaimer, the term of this patent is extended or adjusted under 35 U.S.C. 154(b) by 0 days.

(21) Appl. No.: 14/234,979

(22) PCT Filed: Jul. 17, 2013

(86) PCT No.: PCT/CN2013/079548

§ 371 (c)(1),
(2) Date: Jan. 24, 2014

(87) PCT Pub. No.: WO2014/012497

PCT Pub. Date: Jan. 23, 2014

(65) Prior Publication Data

US 2014/0146973 A1 May 29, 2014

(30) Foreign Application Priority Data

Jul. 18, 2012 (CN) ..... 2012 1 0250072

(51) Int. Cl.
*H04R 29/00* (2006.01)
*H04R 1/10* (2006.01)

(52) U.S. Cl.
CPC ..... *H04R 29/001* (2013.01); *H04R 1/1083* (2013.01); *H04R 29/00* (2013.01)

(58) Field of Classification Search
CPC .... H04R 25/30; H04R 29/00; H04R 2410/05; H04R 1/1083
USPC ..... 73/585; 600/559
See application file for complete search history.

(56) References Cited

U.S. PATENT DOCUMENTS

| | | | | |
|---|---|---|---|---|
| 5,928,160 | A * | 7/1999 | Clark et al. | 600/559 |
| 6,532,296 | B1 * | 3/2003 | Vaudrey et al. | 381/371 |
| 2004/0264706 | A1 * | 12/2004 | Ray et al. | 381/71.11 |
| 2007/0172072 | A1 * | 7/2007 | Yang et al. | 381/58 |
| 2013/0208908 | A1 * | 8/2013 | Theiler et al. | 381/71.6 |

FOREIGN PATENT DOCUMENTS

JP 2012015833 1/2012

OTHER PUBLICATIONS

"How We Measure Noise Isolation." Etymotic, Feb. 20, 2011. Web.*

(Continued)

*Primary Examiner* — Joseph Saunders, Jr.
*Assistant Examiner* — James Mooney
(74) *Attorney, Agent, or Firm* — Boyle Fredrickson, S.C.

(57) ABSTRACT

The present invention discloses a test device and test method for the noise reduction headphone. The test device comprises: an enclosed cavity, a noise source, a test panel, a measuring microphone and a measure comparison module connected with the measuring microphone. The sound emitted from the noise source is sealed within the enclosed cavity. The test panel can cooperate with the noise reduction headphone to form a coupling cavity in the test. The test panel has a sound guiding hole in the common part with the enclosed cavity for transmitting the sound of the noise source into the interior of the coupling cavity. The test panel also has a mounting hole, and the measuring microphone is mounted on the mourning hole towards the direction of the coupling cavity. The measuring microphone records noise signals before and after the noise reduction function of the noise reduction headphone is activated. The measure comparison module receives the signals recorded these two times by the measuring microphone and performs comparison processing to obtain noise reduction amount of the noise reduction headphone. The technical solution of the present invention solves the problem of noise pollution caused by high-power external noise sources to the surrounding environment during the test process of noise reduction amount of the headphone, meanwhile, no special shielding room is required, and the requirement on test environment is relieved.

10 Claims, 4 Drawing Sheets

(56) References Cited

OTHER PUBLICATIONS

"Hearing-Protector Test Fixture Type 45CA Brochure." G.R.A.S. Sound and Vibration, Jun. 2012. Web.*

"Instruction Manual Hearing-Protector Test Fixture Type 45CA." G.R.A.S. Sound and Vibration, Nov. 2013. Web.*

PCT/CN2013/079548 Written Opinion and English Translation of Written Opinion.

* cited by examiner

TEST DEVICE AND TEST METHOD FOR ACTIVE NOISE REDUCTION HEADPHONE

TECHNICAL FIELD

The present invention relates to the technical field of headphone production and test, and particularly relates to a test device and test method for a noise reduction headphone.

BACKGROUND OF THE INVENTION

In high noise environment, in order to protect audition and perform normal communication, the noise reduction headphone is widely used.

During the process of development and production of active noise reduction headphones, the noise reduction amount of the headphone must be tested to determine whether the headphone is qualified. The main work frequency band of the feedback active noise reduction headphone is generally in the range of 20 Hz-4 kHz. In the currently known test solutions, the headphone is worn on a simulation human head or a similar device, and a set of external noise sources are used to generate noise with enough large sound pressure level and enough low frequency at a certain distance. The noise reduction switch of the headphone is switched so as to obtain the difference between the noise picked up by the simulation human head or the similar device before and after the noise reduction function is activated, as the noise reduction amount of the noise reduction headphone. Here, the larger the power of the external noise source is, the larger the sound pressure level thereof will be. The sound pressure level is irrelevant with the frequency.

FIG. 1 is a schematic view of the structure of the existing feedback active noise reduction headphone. As shown in FIG. 1, the feedback active noise reduction headphone 1 is provided with a noise reduction microphone 4 in front of a receiver 2 of the headphone. The noise reduction microphone 4 picks up the noise within the headphone shell. After the noise reduction circuit 3 performs the amplification and filtering processing, the receiver 2 emits a control signal with amplitude equal and phase opposite to the noise collected by the noise reduction microphone 4. The remainder noise after the control signal is superposed and counteracted with the noise within the headphone shell is further picked up, processed and counteracted by the noise reduction microphone 4. This process is repeated until the remainder noise in headphone shell is stable. The process of the feedback noise reduction processing is a negative feedback process, which is briefly illustrated in FIG. 2.

FIG. 2 is a schematic view of mathematical model of the noise reduction principle of the existing feedback active noise reduction headphone. Referring to FIG. 2, symbol G represents the transfer function from the receiver 2 to the noise reduction microphone 4, symbol H represents the transfer function of the noise reduction circuit 3, symbol z represents the noise within the headphone shell, and symbol c represents the remainder noise, then:

$$S = \frac{c}{z} = \frac{1}{1 - GH}$$

wherein, symbol S represents the noise reduction amount of the feedback system. From the principle of the feedback active noise reduction headphone, as long as G and H remain invariable, the feedback system will stably reduce the signal picked up by the noise reduction microphone by S times.

In order to measure the noise reduction amount of the feedback active noise reduction headphone accurately, it is required that the noise at the noise reduction microphone is at least S times larger than the background noise of environmental when the noise reduction function is deactivated. By this way, when the noise reduction function is activated, the remainder noise will not be less than the background noise, whereby the difference value between them two can really represent the noise reduction amount of the headphone. Thus it can be seen that a high-power external noise source is required in order to realize effective test. In particular, in the test on a product line, the background noise in the production plant is generally high, and is concentrically distributed in low frequency range, and thus the requirement on low frequency noise of the noise source is higher, which increases test cost and brings large noise pollution.

Therefore, a critical difficulty in implementing the above test solution is the external noise source requires large enough power and low enough frequency, and such a test system may cause noise pollution to the surrounding environment.

In order to avoid noise pollution, the existing test is usually performed in a shielding room. However, in this way, the demand condition of the test is further increased, i.e., the complexity of the test is increased.

SUMMARY OF THE INVENTION

In view of this, the present invention provides a test device and test method for a noise reduction headphone so as to solve the problem of noise pollution caused by high-power external noise source to the surrounding environment during the test process of noise reduction amount of the headphone, and moreover, test complexity is not increased.

In order to achieve the above purpose, the technical solution of the present invention is realized in the following way:

The present invention discloses a test device for a noise reduction headphone, and the device comprises: an enclosed cavity, a noise source, a test panel, a measuring microphone and a measure comparison module connected with the measuring microphone, wherein, the sound emitted from the noise source is sealed in the enclosed cavity;

the test panel can cooperate with the noise reduction headphone to form a coupling cavity in the test; the test panel has a sound guiding hole in the common part with the enclosed cavity for transmitting the sound of the noise source to the interior of the coupling cavity; the test panel also has a mounting hole, and the measuring microphone is mounted on the mounting hole towards the direction of the coupling cavity;

the measuring microphone records noise signals before and after the noise reduction function of the noise reduction headphone is activated; the measure comparison module receives the signals recorded these two times by the measuring microphone and performs comparison to obtain the noise reduction amount of the noise reduction headphone.

The present invention also discloses a test method for a noise reduction headphone, and the method comprises:

sealing the sound emitted by the noise source within an enclosed cavity;

providing a test panel that can cooperate with the noise reduction headphone to form a coupling cavity in the test;

providing a sound guiding hole in the common part of the test panel with the enclosed cavity for transmitting the sound of the noise source into the interior of the coupling cavity;

providing a mounting hole in the test panel for mounting the measuring microphone on the mounting hole towards the direction of the coupling cavity;

in performing the test, placing the noise reduction headphone on the test panel, then using the measuring, microphone to record noise signals before and after the noise reduction function of the noise reduction headphone is activated, comparing the signals recorded these two times by the measuring microphone to obtain the noise reduction amount of the noise reduction headphone.

Such a technical solution of the present invention can seal the sound emitted by the noise source within the enclosed cavity, thereby effectively isolating noise pollution of the noise source from the surrounding environment. Meanwhile, since the test panel can cooperate with the noise reduction headphone to form a coupling cavity in the test, and the sound of the noise source in the enclosed cavity can be transferred to the coupling cavity through the sound guiding hole in the common part of the test panel with the enclosed cavity. So the special shielding room is no longer required, and the requirement on the test environment is relieved, i.e., it is unnecessary to require a lower background noise of the test environment and no other noise sources, thereby the complexity of the test is reduced.

DETAILED DESCRIPTION OF THE INVENTION

The objects, solutions, and advantages of the present invention will become more apparent upon consideration of the following description with reference to the accompanying drawings.

Figure 1:
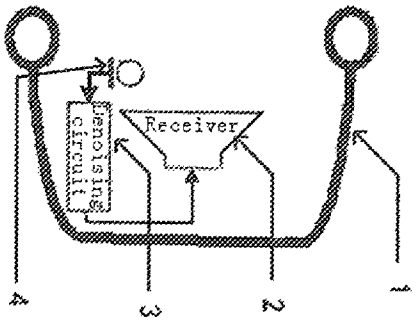
FIG. 1 is a schematic view of the structure of the existing feedback active noise reduction headphone.
Figure 2:
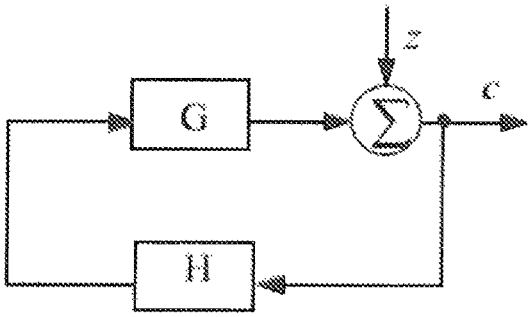
FIG. 2 is a schematic view of the mathematical model of the noise reduction principle of the existing feedback active noise reduction headphone.
Figure 3:
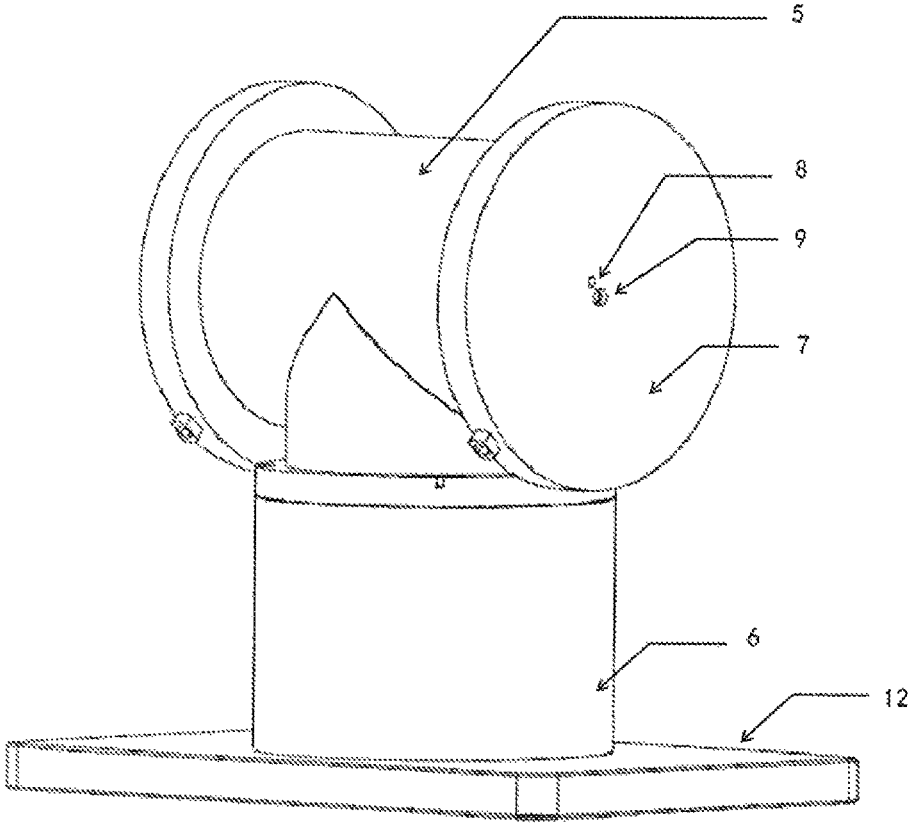
FIG. 3 is a schematic view of the external structure of the test device for the noise reduction headphone according to embodiment 1 of the present invention.
Figure 4:
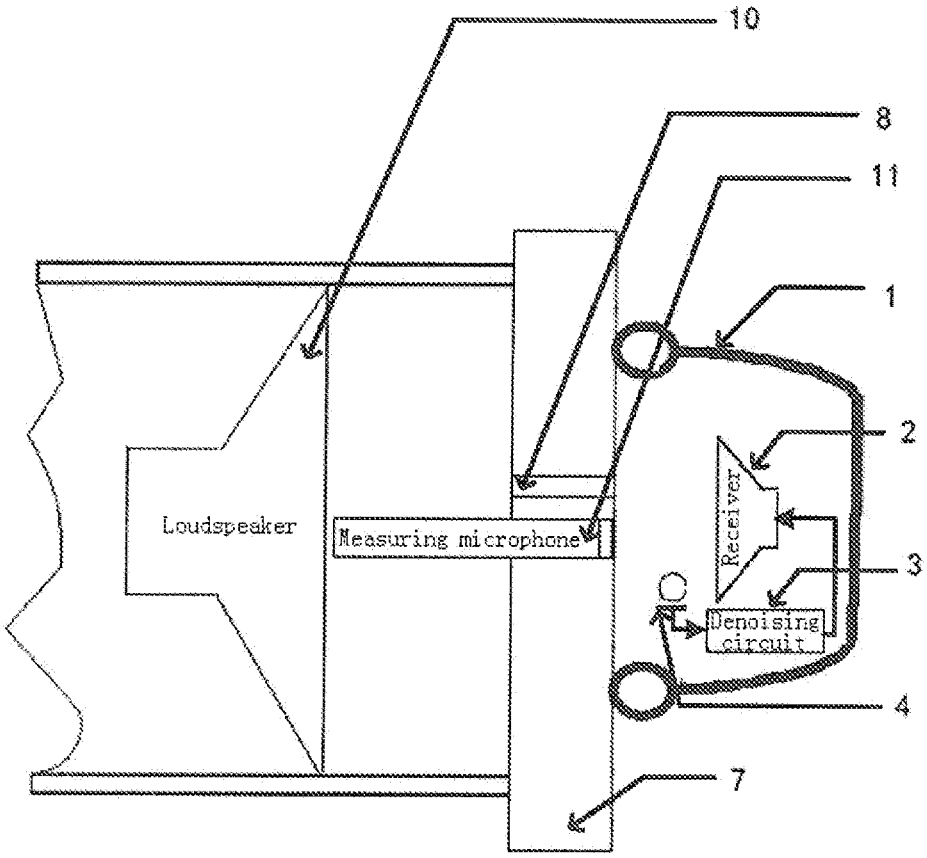
FIG. 4 is a schematic view showing the internal structure of the test device for the noise reduction headphone shown in FIG. 3 and the test in cooperation with the headphone.

FIG. 3 is a schematic view of the external structure of the test device for the noise reduction headphone according to embodiment 1 of the present invention. FIG. 4 is a schematic view showing the internal structure of the test device for the noise reduction headphone show in FIG. 3 and the test in cooperation with the headphone.

Referring to FIG. 3 and FIG. 4, the test device according to this embodiment is a test device suitable for a circumaural noise reduction headphone, comprising: an enclosed cavity consisting of a base 12, a vertical cavity 6, a horizontal cavity 5 and a test panel 7. In this embodiment a loudspeaker 10 is taken as the noise source, and in other embodiments of the present invention a simulation mouth or other sound source components can be used instead.

The lower end of the vertical cavity 6 is fixed on the base 12, the upper end of the vertical cavity 6 is communicated with the horizontal cavity 5; the two ends of the horizontal cavity 5 are respectively mounted to two test panels 7 to form an enclosed cavity; and the high-power loudspeaker 10 is located within the enclosed cavity. In FIGS. 3 and 4, only the test panel 7 at one end of the horizontal cavity 5 is illustrated, and the other end thereof has the same structure.

When performing binaural testing, the two test panels 7 are coupled with the two earpieces of the tested headphone respectively. The shape of the test panel 7 can be adjusted based on the shape of the tested headphone, and can be plane, convex or concave so as to make the test panel to cooperate with the noise reduction headphone to form a coupling cavity.

There is a sound guiding hole 8 in the test panel 7 for transmitting the sound of the loudspeaker 10 from the enclosed cavity to the coupling cavity. There is also a mounting hole 9 in the test panel 7, and a measuring microphone 11 is mounted on the mounting hole 9 towards the exterior of the enclosed cavity and towards the direction of the coupling cavity. The measuring microphone 11 is used to record the noise signals before and after the noise reduction function of the noise reduction headphone is activated.

The test device according to this embodiment further comprises a measure comparison module (not shown) connected with the measuring microphone 11; the measure comparison module receives the signals recorded by the measuring microphone these two times: when the noise reduction function of the noise reduction headphone is activated and deactivated, and makes comparison to obtain the noise reduction amount of the noise reduction headphone. The measure comparison module may be either located within the enclosed cavity or located outside the enclosed cavity.

When performing the test, the tested headphone is pressed on the test panel 7 (as shown in FIG. 4), so as to ensure that the tested headphone 1 and the test panel 7 are well coupled to form a coupling cavity. In this embodiment, the test panel 7 is plane, and the measuring microphone 11 and the sound guiding hole 8 are within the coupling cavity enclosed by the tested headphone 1 and the test panel 7. The noise, used in the test, emitted by the loudspeaker 10 is transferred to the coupling cavity enclosed by the tested headphone 1 and the test panel 7 through the sound guiding hole 8, and the noise pressure level just needs to meet the condition for measuring the noise reduction amount. The measuring microphone 11 records the noise within the headphone shell, and after the recorded signal becomes stable, the noise reduction function of the tested headphone 1 is activated, and then the measuring microphone 11 records the remainder noise within the headphone shell again. The difference between signals recorded these two times is the noise reduction amount of the tested headphone 1.

In the above embodiment, the sound guiding hole 8 and the mounting hole 9 for mounting the measuring microphone are arranged in the test panel of the enclosed cavity, therefore, the noise in the enclosed cavity can be effectively transmitted to the tested headphone and the noise in the coupling cavity can be recorded, so as to realize measurement of the noise reduction amount.

In the above embodiment, the size of the mounting hole 9 just needs to keep consistent with the diameter of the measuring microphone 11 being used. The mounting hole 9 is a through hole. The measuring microphone 11 is placed towards the direction of the receiver of the headphone. Except the sound guiding hole 8 and the mounting hole 9, other parts of the test device are enclosed.

In the above embodiment, the test panel 7 is provided with one sound guiding hole. In other embodiments of the present invention, a plurality of sound guiding holes can be provided. The diameter of the sound guiding hole should not be too large, otherwise, it may influence the transfer function G from the receiver 2 of the tested headphone 1 to the noise reduction microphone 4, thereby influencing the noise reduction amount of the headphone.

In the above embodiment, only one loudspeaker is placed in the enclosed cavity of the test device. In other embodiments of the present invention, a plurality of loudspeakers or simulation mouths can also be placed based on actual requirements.

Figure 5:
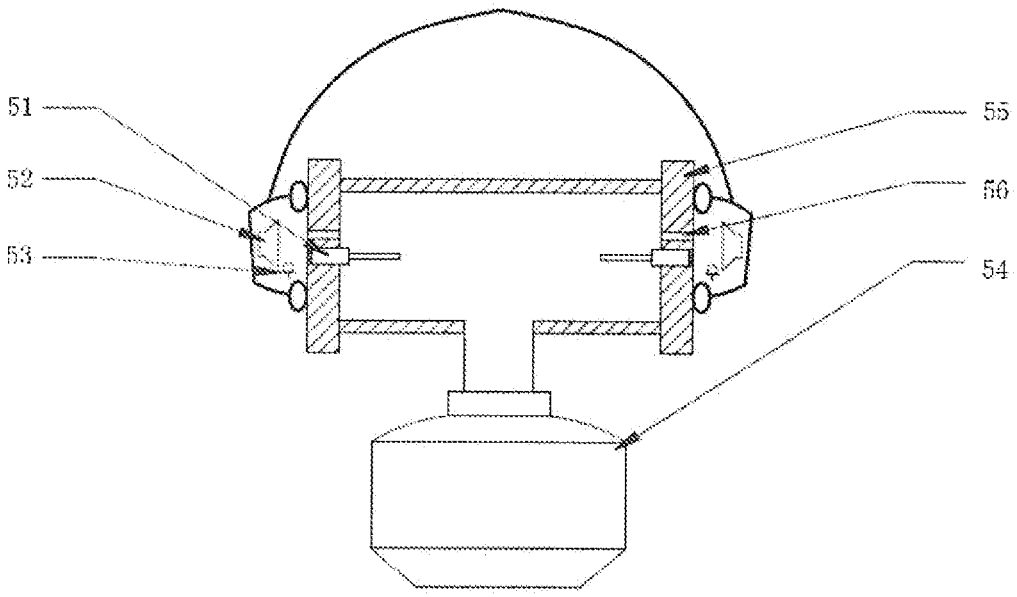
FIG. 5 is a schematic view of the structure of the noise reduction headphone and its test device according to embodiment 2 of the present invention.

FIG. 5 is a schematic view showing the structure of the noise reduction headphone and its test device according to embodiment 2 of the present invention. Referring to FIG. 5, it shows a measuring microphone 51, a receiver 52 of the circumaural noise reduction headphone, a noise reduction microphone 53 of the circumaural noise reduction headphone, a simulation mouth 54 as a noise source, a test panel 55 and a sound guiding hole 56.

The structure of the test device in embodiment 2 as shown in FIG. 5 is similar to the structure of the test device in embodiment 1 as shown in FIGS. 3 and 4, and both are test devices suitable for the circumaural noise reduction headphone. The difference lies in that in FIG. 5 the enclosed cavity consists of a cylindrical cavity and test panels placed at two ends of the cavity, and the noise source is a simulation mouth located outside of the enclosed cavity. The simulation mouth is connected with an interface on the enclosed cavity, such that the sound emitted by the simulation mouth is transferred into the enclosed cavity.

In the above embodiment, the tested headphone is a circumaural headphone, which has a relatively large earflap. Therefore, the test panel is plane, and the coupling cavity is formed within the earflap in the test. The test device provided in the present invention is also applicable for the in-ear headphone, and thus the test panel can be designed to be a concave. In this way, it can cooperate with the in-ear headphone to form a test coupling cavity, as shown in the following embodiment.

Figure 6:
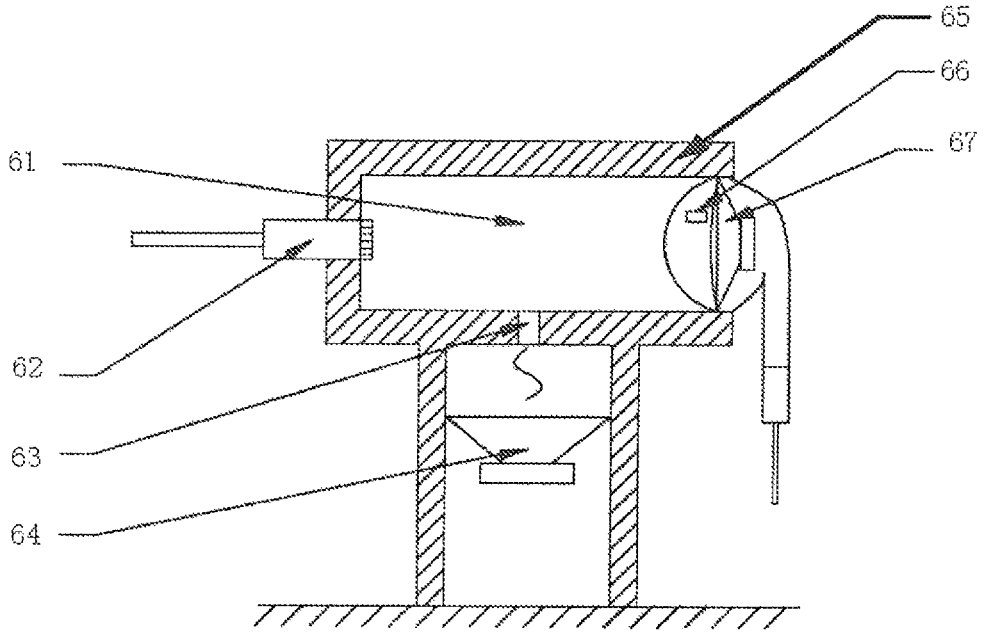
FIG. 6 is a schematic view of the structure of the noise reduction headphone and its test device according to embodiment 3 of the present invention.

FIG. 6 is a schematic view showing the structure of the noise reduction headphone and its test device according to embodiment 3 of the present invention. Referring to FIG. 6, it shows a measuring microphone 62, a sound guiding hole 63, a loudspeaker 64, a test panel 65, a noise reduction microphone 66 of the noise reduction headphone and a receiver 67 of the noise reduction headphone. The test device according to this embodiment is applicable for the in-ear noise reduction headphone.

Referring to FIG. 6, in embodiment 3, the noise source is located within the enclosed cavity. The test panel is a concave which simulates the auricle of human ear. In the test, the test panel cooperates with the in-ear noise reduction headphone to form a coupling cavity 61. In FIG. 6, the notch of the test panel is directed towards the horizontal direction. In other embodiments of the present invention, the notch of the test panel may also face upwards.

Figure 7:
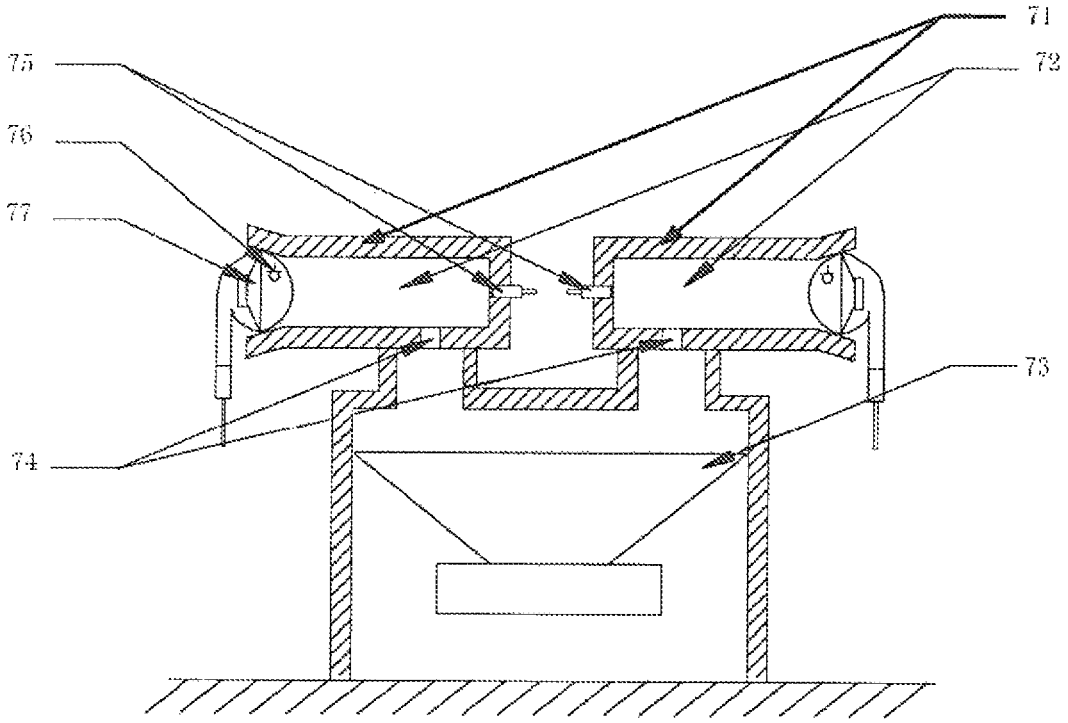
FIG. 7 is a schematic view of the structure of the noise reduction headphone and its test device according to embodiment 4 of the present invention.

FIG. 7 is a schematic view showing the structure of the noise reduction headphone and its test device according to embodiment 4 of the present invention. Referring to FIG. 7, it shows a test panel 71, a loudspeaker 73, a sound guiding hole 74, a measuring microphone 75, a noise reduction microphone 76 of the noise reduction headphone and a receiver 77 of the noise reduction headphone. The test device in this embodiment is also applicable for the in-ear noise reduction headphone. In the test, the concave test panel cooperates with the in-ear noise reduction headphone to form a coupling cavity 72.

It can be seen that the test device in the embodiment 3 as shown in FIG. 6 can only test a monaural headphone at the same time, while the test device in embodiment 4 as shown in FIG. 7 can test a binaural headphone at the same time. In other embodiments of the present invention, the number of the test panels can be further increased so as to realize simultaneous test of more headphones.

In all the above embodiments, the sound guiding hole of the test device may be filled with or affixed with sound damping material. The sound damping material may specifically be cotton, sponge, fibers and so on.

In embodiment 5 of the present invention, the receiver of the noise reduction headphone itself can be used as the noise source, and the shell of the noise reduction headphone itself cooperates with the test panel to form an enclosed cavity. In this embodiment the test device for the noise reduction headphone comprises a test panel, a measuring microphone and a measure comparison module connected with the measuring microphone, and moreover, the receiver of the noise reduction headphone serves as the noise source of the test device, and the shell of the noise reduction headphone serves as the shell of the test device, wherein the test panel has a mounting hole, the measuring microphone is mounted on the mounting hole. In the test, the noise reduction headphone is pressed on the test panel, and the measure comparison module receives the signals recorded by the measuring microphone these two times: when the noise reduction function of the noise reduction headphone is activated and deactivated, and makes comparison to obtain the noise reduction amount of the noise reduction headphone.

Based on the above embodiments, the present invention provides a test method for the noise reduction headphone, and the method comprises:

sealing the sound emitted by the noise source within an enclosed cavity;

providing a test panel that can cooperate with the noise reduction headphone to form a coupling cavity in the test;

providing a sound guiding hole in the common part of the test panel with the enclosed cavity for transmitting the sound of the noise source to the interior of the coupling cavity;

providing a mounting hole in the test panel, mounting the measuring microphone on the mounting hole towards the direction of the coupling cavity; and in performing the test, placing the noise reduction headphone on the test panel to form a coupling cavity, then using the measuring microphone to record noise signals before and after the noise reduction function of the noise reduction headphone is activated, comparing the signals recorded these two times by the measuring microphone to obtain noise reduction amount of the noise reduction headphone.

In the above method, one or more test panels can be provided. When a plurality of test panels are provided, each test panel can cooperate with the corresponding noise reduction headphone to form an independent coupling cavity in the test. Each test panel is provided with a sound guiding hole in the common part with the enclosed cavity for transmitting the sound of the noise source to the interior of the corresponding coupling cavity. Each test panel is provided with a mounting hole so as to mount the same number of the measuring microphones as that of the test panels on the mounting holes of respective test panels in one to one correspondence.

Sealing the sound emitted by the noise source within the enclosed cavity may be specifically implemented in following manner: placing the noise source within the enclosed cavity, or placing the noise source outside the enclosed cavity, and connecting the noise source with an interface on the enclosed cavity to form an integral seal, such that the sound emitted by the noise source is transferred into the enclosed cavity.

In the above method, specifically one or more sound guiding holes may be arranged on the test panel.

The above method further comprises: filling or affixing sound damping material at the sound guiding hole.

It should be noted that the above technical solutions of the present invention are not only applicable for testing the feedback active noise reduction headphone, but also for testing the feedforward active noise reduction headphone.

Such a technical solution of the present invention can effectively isolate noise pollution of the noise source from the surrounding environment because the sound emitted by the noise source is sealed in the enclosed cavity. Meanwhile, since the test panel can cooperate with the noise reduction headphone to form a coupling cavity in the test, and the sound of the noise source in the enclosed cavity can be transferred to the coupling cavity through the sound guiding hole in the common part of the test panel with the enclosed cavity. So the special shielding room is no longer required, and the requirement on the test environment is relieved, i.e., it is unnecessary to require a lower background noise of the test environment and no any other noise sources, thereby, the complexity of the test is reduced.

The above are only preferred embodiments of the present invention, rather than limitations to the protection scope of the present invention. Any modifications, equivalent replacements and improvements made within the spirit and principle of the present invention are covered within the protection scope of the present invention.

The invention claimed is:

1. A test device for conducting a test on a noise reduction headphone, characterized in that the test device comprises an enclosed cavity, a noise source, a test panel, a measuring microphone and a measure comparison module connected with the measuring microphone, wherein, the sound emitted from the noise source is sealed within the enclosed cavity;

the test panel can cooperate with the noise reduction headphone to form a coupling cavity during the test; the test panel has a sound guiding hole in the common part with the enclosed cavity for transmitting the sound of the noise source into the interior of the coupling cavity; the test panel also has a mounting hole, the measuring microphone is mounted on the mounting hole towards the direction of the coupling cavity;

the measuring microphone records noise signals before and after the noise reduction function of the noise reduction headphone is activated; the measure comparison module receives the signals recorded these two times by the measuring microphone and performs comparison processing to obtain the noise reduction amount of the noise reduction headphone.

2. The test device for a noise reduction headphone according to claim 1, characterized in that, the number of the test panel is multiple;

the number of the measuring microphones is same as that of the test panels, and the measuring microphones and the test panels are in one to one correspondence;

each test panel can cooperate with a corresponding noise reduction headphone to form an independent coupling cavity in the test; each test panel has a sound guiding hole in the common part with the enclosed cavity for transmitting the sound of the noise source into the interior of the corresponding coupling cavity; and each test panel has a mounting hole, and the corresponding measuring microphone is mounted on the mounting hole towards the direction of the corresponding coupling cavity;

each measuring microphone records noise signals before and after the noise reduction function of the corresponding noise reduction headphone is activated; the measure comparison module receives the signals recorded these two times by each measuring microphone and performs comparison processing to obtain noise reduction amount of each corresponding noise reduction headphone.

3. The test device for a noise reduction headphone according to claim 1, characterized in that, the test panel is plane, concave or convex.

4. The test device for a noise reduction headphone according to claim 1, characterized in that, the noise source is located within the enclosed cavity;

or the noise source is located outside the enclosed cavity, and connected with an interface on the enclosed cavity to form an integral seal, such that the sound emitted by the noise source is transferred into the enclosed cavity.

5. The test device for a noise reduction headphone according to claim 1, characterized in that, the noise source is a first noise source; and there are one or more additional noise sources in the test device.

6. The test device for a noise reduction headphone according to claim 1, characterized in that, the sound guiding hole in the test panel is a first sound guiding hole; and there are one or more additional sound guiding holes in the test panel.

7. The test device for a noise reduction headphone according to claim 1, characterized in that, the sound guiding hole is filled with or affixed with sound damping material.

8. A test method for conducting a test on a noise reduction headphone, comprising the steps of:

sealing the sound emitted by a noise source within an enclosed cavity;

providing a test panel that can cooperate with a noise reduction headphone to form a coupling cavity during the test;

providing a sound guiding hole in a common part of the test panel with the enclosed cavity for transmitting the sound of the noise source into the interior of the coupling cavity;

providing a mounting hole in the test panel and mounting a measuring microphone on a mounting hole towards the direction of the coupling cavity;

in performing the test, placing the noise reduction headphone on the test panel to form the coupling cavity, then using the measuring microphone to record noise signals before and after the noise reduction function of the noise reduction headphone is activated, comparing the signals recorded these two times by the measuring microphone to obtain a noise reduction amount of the noise reduction headphone.

9. The test method for a noise reduction headphone according to claim 8, characterized in that, said providing a test panel that can cooperate with the noise reduction headphone to form a coupling cavity in the test, said providing a sound guiding hole in the common part of the test panel with the enclosed cavity for transmitting the sound of the noise source into the interior of the coupling cavity and said providing a mounting hole in the test panel and mounting the measuring microphone on the mounting hole towards the direction of the coupling cavity comprise:

providing multiple test panels, each test panel can cooperate with a corresponding noise reduction headphone to form an independent coupling cavity in the test;

providing a sound guiding hole in the common part of each test panel with the enclosed cavity for transmitting the sound of the noise source into the interior of the corresponding coupling cavity; and providing a mounting hole on each test panel and mounting the same number of the measuring microphones as that of the test panels on the mounting holes of respective test panels in one to one correspondence.

10. The test method for a noise reduction headphone according to claim 8, characterized in that, said sealing the sound emitted by the noise source within the enclosed cavity comprises:

placing the noise source in the enclosed cavity;

or placing the noise source outside the enclosed cavity, and connecting the noise source with an interface on the enclosed cavity to form an integral seal, such that the sound emitted by the noise source is transferred into the enclosed cavity.

* * * * *